US007354307B2

(12) United States Patent
Chee et al.

(10) Patent No.: US 7,354,307 B2
(45) Date of Patent: Apr. 8, 2008

(54) END CONNECTOR FOR COAXIAL CABLE

(75) Inventors: Alexander B. Chee, Marietta, GA (US); Linan Gan, Guangdong (CN)

(73) Assignee: Pro Brand International, Inc., Marietta, GA (US)

( * ) Notice: Subject to any disclaimer, the term of this patent is extended or adjusted under 35 U.S.C. 154(b) by 0 days.

(21) Appl. No.: 11/426,398

(22) Filed: Jun. 26, 2006

(65) Prior Publication Data

US 2006/0292926 A1 Dec. 28, 2006

Related U.S. Application Data

(60) Provisional application No. 60/791,624, filed on Apr. 13, 2006, provisional application No. 60/694,333, filed on Jun. 27, 2005.

(51) Int. Cl.
*H01R 9/05* (2006.01)

(52) U.S. Cl. ..... 439/584; 439/272

(58) Field of Classification Search ..... 439/272, 439/275, 277, 320, 578–588
See application file for complete search history.

(56) References Cited

U.S. PATENT DOCUMENTS 1,793,803 A * 2/1931 Hurley et al. ..... 174/152 S
2,258,737 A 10/1941 Browne
2,762,021 A * 9/1956 Battey et al. ..... 439/125
3,184,706 A 5/1965 Atkins
3,275,913 A 9/1966 Blanchard
3,355,698 A 11/1967 Keller
3,373,243 A 3/1968 Janowiak et al.
3,406,373 A 10/1968 Forney, Jr.
3,448,430 A 6/1969 Kelly
3,475,545 A 10/1969 Stark et al.
3,498,647 A 3/1970 Schroder
3,517,373 A 6/1970 Jamon
3,533,051 A 10/1970 Ziegler, Jr.
3,537,065 A 10/1970 Winston
3,544,705 A 12/1970 Winston
3,564,487 A 2/1971 Upstone et al.
3,629,792 A 12/1971 Dorrell
3,633,150 A 1/1972 Swartz
3,668,612 A 6/1972 Nepovim
3,671,922 A 6/1972 Zerlin et al.
3,710,005 A 1/1973 French
3,739,076 A 6/1973 Schwartz
3,845,453 A 10/1974 Hemmer
3,846,738 A 11/1974 Nepovim
3,910,673 A 10/1975 Stokes
3,915,539 A 10/1975 Collins
3,936,132 A 2/1976 Hutter (Continued)

FOREIGN PATENT DOCUMENTS

EP 0116157 8/1984

(Continued)

*Primary Examiner*—James Harvey
(74) *Attorney, Agent, or Firm*—Womble Carlyle, Sandridge & Rice, PLLC

(57) ABSTRACT

A connector for attaching a cable to a terminal includes a connector body with a hex head fastener rotatably attached at one end of the body. A compressible gasket or clamp sleeve is positioned along the connector body for engaging and sealing about a portion of the jacket of the cable received within the connector.

6 Claims, 9 Drawing Sheets

U.S. PATENT DOCUMENTS

| | | | | |
|---|---|---|---|---|
| 3,976,352 | A | | 8/1976 | Spinner |
| 3,985,418 | A | | 10/1976 | Spinner |
| 4,046,451 | A | | 9/1977 | Juds et al. |
| 4,053,200 | A | | 10/1977 | Pugner |
| 4,059,330 | A | | 11/1977 | Shirey |
| 4,126,372 | A | | 11/1978 | Hashimoto et al. |
| 4,156,554 | A | | 5/1979 | Aujla |
| 4,168,921 | A | | 9/1979 | Blanchard |
| 4,225,162 | A | | 9/1980 | Dola |
| 4,227,765 | A | | 10/1980 | Neumann et al. |
| 4,250,348 | A | | 2/1981 | Kitagawa |
| 4,280,749 | A | | 7/1981 | Hemmer |
| 4,339,166 | A | | 7/1982 | Dayton |
| 4,346,958 | A | | 8/1982 | Blanchard |
| 4,354,721 | A | | 10/1982 | Luzzi |
| 4,373,767 | A | | 2/1983 | Cairns |
| 4,400,050 | A | | 8/1983 | Hayward |
| 4,408,821 | A | | 10/1983 | Forney, Jr. |
| 4,408,822 | A | | 10/1983 | Nikitas |
| 4,444,453 | A | | 4/1984 | Kirby et al. |
| 4,484,792 | A | | 11/1984 | Tengler et al. |
| 4,515,427 | A | | 5/1985 | Smit |
| 4,533,191 | A | | 8/1985 | Blackwood |
| 4,540,231 | A | | 9/1985 | Forney, Jr. |
| 4,545,637 | A | | 10/1985 | Bosshard et al. |
| 4,575,274 | A | | 3/1986 | Hayward |
| 4,583,811 | A | | 4/1986 | McMills |
| 4,596,434 | A | | 6/1986 | Saba et al. |
| 4,596,435 | A | | 6/1986 | Bickford |
| 4,598,961 | A | | 7/1986 | Cohen |
| 4,600,263 | A | | 7/1986 | DeChamp et al. |
| 4,614,390 | A | | 9/1986 | Baker |
| 4,645,281 | A | | 2/1987 | Burger |
| 4,650,228 | A | | 3/1987 | McMills et al. |
| 4,655,159 | A | | 4/1987 | McMills |
| 4,660,921 | A | | 4/1987 | Hauver |
| 4,668,043 | A | | 5/1987 | Saba et al. |
| 4,674,818 | A | | 6/1987 | McMills et al. |
| 4,676,577 | A | | 6/1987 | Szegda |
| 4,691,976 | A | | 9/1987 | Cowen |
| 4,698,027 | A | * | 10/1987 | Vandame ..... 439/271 |
| 4,703,987 | A | | 11/1987 | Gallusser et al. |
| 4,717,355 | A | | 1/1988 | Mattis |
| 4,720,271 | A | | 1/1988 | Grange |
| 4,738,009 | A | | 4/1988 | Down |
| 4,746,305 | A | | 5/1988 | Nomura |
| 4,747,786 | A | | 5/1988 | Hayashi et al. |
| 4,755,152 | A | | 7/1988 | Elliot et al. |
| 4,761,146 | A | | 8/1988 | Sohoel |
| 4,772,222 | A | | 9/1988 | Laudig et al. |
| 4,789,355 | A | | 12/1988 | Lee |
| 4,806,116 | A | | 2/1989 | Ackerman |
| 4,813,886 | A | | 3/1989 | Roos et al. |
| 4,834,675 | A | | 5/1989 | Samshisen |
| 4,834,676 | A | | 5/1989 | Tackett |
| 4,854,893 | A | | 8/1989 | Morris |
| 4,857,014 | A | | 8/1989 | Alf et al. |
| 4,869,679 | A | | 9/1989 | Szegda |
| 4,874,331 | A | | 10/1989 | Iverson |
| 4,892,275 | A | | 1/1990 | Szegda |
| 4,902,246 | A | | 2/1990 | Samchisen |
| 4,906,207 | A | | 3/1990 | Banning et al. |
| 4,923,412 | A | | 5/1990 | Morris |
| 4,925,403 | A | | 5/1990 | Zorzy |
| 4,927,385 | A | | 5/1990 | Cheng |
| 4,929,188 | A | | 5/1990 | Lionetto et al. |
| 4,952,174 | A | | 8/1990 | Sucht et al. |
| 4,957,456 | A | | 9/1990 | Olson et al. |
| 4,973,265 | A | | 11/1990 | Heeren |
| 4,979,911 | A | | 12/1990 | Spencer |
| 4,990,104 | A | | 2/1991 | Schieferly |
| 4,990,105 | A | | 2/1991 | Karlovich |
| 4,990,106 | A | | 2/1991 | Szegda |
| 5,002,503 | A | | 3/1991 | Campbell et al. |
| 5,007,861 | A | | 4/1991 | Stirling |
| 5,021,010 | A | | 6/1991 | Wright |
| 5,024,606 | A | | 6/1991 | Ming-Hwa |
| 5,037,328 | A | | 8/1991 | Karlovich |
| 5,062,804 | A | | 11/1991 | Jamet et al. |
| 5,066,248 | A | | 11/1991 | Gaver |
| 5,073,129 | A | | 12/1991 | Szegda |
| 5,083,943 | A | | 1/1992 | Tarrant |
| 5,120,260 | A | | 6/1992 | Jackson |
| 5,127,853 | A | | 7/1992 | McMills et al. |
| 5,131,862 | A | | 7/1992 | Gershfeld |
| 5,141,451 | A | | 8/1992 | Down |
| 5,161,993 | A | | 11/1992 | Leibfried, Jr. |
| 5,181,161 | A | | 1/1993 | Hirose et al. |
| 5,195,906 | A | | 3/1993 | Szegda |
| 5,205,761 | A | | 4/1993 | Nilsson |
| 5,207,602 | A | | 5/1993 | McMills et al. |
| 5,217,391 | A | | 6/1993 | Fisher, Jr. |
| 5,217,393 | A | | 6/1993 | Del Negro et al. |
| 5,269,701 | A | | 12/1993 | Leibfried, Jr. |
| 5,283,853 | A | | 2/1994 | Szegda |
| 5,284,449 | A | | 2/1994 | Vaccaro |
| 5,295,864 | A | | 3/1994 | Birch et al. |
| 5,316,494 | A | | 5/1994 | Flanagan et al. |
| 5,338,225 | A | | 8/1994 | Jacobsen et al. |
| 5,342,218 | A | | 8/1994 | McMills et al. |
| 5,354,217 | A | | 10/1994 | Gabel et al. |
| 5,371,819 | A | | 12/1994 | Szegda |
| 5,371,821 | A | | 12/1994 | Szegda |
| 5,371,827 | A | | 12/1994 | Szegda |
| 5,393,244 | A | | 2/1995 | Szegda |
| 5,431,583 | A | | 7/1995 | Szegda |
| 5,435,745 | A | | 7/1995 | Booth |
| 5,444,810 | A | | 8/1995 | Szegda |
| 5,455,548 | A | | 10/1995 | Grandchamp et al. |
| 5,456,611 | A | | 10/1995 | Henry et al. |
| 5,456,614 | A | | 10/1995 | Szegda |
| 5,466,173 | A | | 11/1995 | Down |
| 5,470,257 | A | | 11/1995 | Szegda |
| 5,494,454 | A | | 2/1996 | Johnsen |
| 5,501,616 | A | | 3/1996 | Holliday |
| 5,525,076 | A | | 6/1996 | Down |
| 5,542,861 | A | | 8/1996 | Anhalt et al. |
| 5,548,088 | A | | 8/1996 | Gray et al. |
| 5,557,073 | A | * | 9/1996 | Truesdale et al. ..... 174/151 |
| 5,571,028 | A | | 11/1996 | Szegda |
| 5,586,910 | A | | 12/1996 | Del Negro et al. |
| 5,598,132 | A | | 1/1997 | Stabile |
| 5,607,325 | A | | 3/1997 | Toma |
| 5,620,339 | A | | 4/1997 | Gray et al. |
| 5,632,651 | A | | 5/1997 | Szegda |
| 5,651,699 | A | | 7/1997 | Holliday |
| 5,667,405 | A | | 9/1997 | Holliday |
| 5,863,220 | A | | 1/1999 | Holliday |
| 5,879,191 | A | | 3/1999 | Burris |
| 5,888,094 | A | | 3/1999 | Kubota et al. |
| 5,975,951 | A | | 11/1999 | Burris et al. |
| 5,997,350 | A | | 12/1999 | Burris et al. |
| 6,032,358 | A | | 3/2000 | Wild |
| 6,042,422 | A | | 3/2000 | Youtsey |
| 6,089,913 | A | | 7/2000 | Holliday |
| 6,146,197 | A | | 11/2000 | Holliday et al. |
| 6,153,830 | A | | 11/2000 | Montena |
| 6,163,830 | A | | 12/2000 | Nguyen et al. |
| 6,179,656 | B1 | | 1/2001 | Wong |
| D437,826 | S | | 2/2001 | Montena |
| 6,210,222 | B1 | | 4/2001 | Langham et al. |
| 6,217,383 | B1 | | 4/2001 | Holland et al. |
| 6,241,553 | B1 | | 6/2001 | Hsia |
| 6,261,126 | B1 | | 7/2001 | Stirling |

| | | | |
|---|---|---|---|
| 6,267,621 | B1 | 7/2001 | Pitschi et al. |
| D458,904 | S | 6/2002 | Montena |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 8/2002 | Fox |
| D468,696 | S | 1/2003 | Montena |
| 6,530,807 | B2 | 3/2003 | Rodrigues et al. |
| 6,558,194 | B2 | 5/2003 | Montena |
| 6,592,403 | B2 | 7/2003 | Koolman |
| 6,676,446 | B2 | 1/2004 | Montena |
| 6,767,247 | B2 | 7/2004 | Rodrigues |
| 6,767,248 | B1 | 7/2004 | Hung |
| 6,780,052 | B2 | 8/2004 | Montena et al. |
| 6,783,394 | B1 | 8/2004 | Holliday |
| 6,817,896 | B2 | 11/2004 | Derenthal |
| 6,817,897 | B2 | 11/2004 | Chee |
| 6,830,479 | B2 | 12/2004 | Holliday |
| 6,848,939 | B2 | 2/2005 | Stirling |
| 6,848,940 | B2 | 2/2005 | Montena |
| 6,994,588 | B2 | 2/2006 | Montena |
| 7,018,235 | B1 * | 3/2006 | Burris et al. ..... 439/584 |
| D519,076 | S | 4/2006 | Fox |
| D519,451 | S | 4/2006 | Fox |
| 7,021,965 | B1 | 4/2006 | Montena |
| 7,029,304 | B2 | 4/2006 | Montena |
| 7,044,785 | B2 | 5/2006 | Harwath |
| 7,063,565 | B2 | 6/2006 | Ward |
| 2006/0172571 | A1 | 8/2006 | Montena |
| 2006/0292926 | A1 * | 12/2006 | Chee et al. ..... 439/584 |

FOREIGN PATENT DOCUMENTS

| | | |
|---|---|---|
| EP | 0167738 | 8/1984 |
| EP | 0265276 | 4/1988 |
| GB | 1087228 | 10/1967 |
| GB | 1270846 | 4/1972 |
| GB | 2019665 | 10/1979 |
| GB | 2079549 | 10/1982 |

* cited by examiner

END CONNECTOR FOR COAXIAL CABLE

CROSS REFERENCE TO RELATED APPLICATION

The present application claims the benefit of U.S. Provisional Patent Applications Ser. Nos. 60/791,624, filed Apr. 13, 2006, and 60/694,333, filed Jun. 27, 2005, the disclosures of which are incorporated herein by reference in their entireties.

FIELD OF THE INVENTION

The present invention generally relates to connectors for cables. More particularly, the present invention relates to an end for coaxial cable for use as an F type connector for cable TV and satellite TV.

BACKGROUND OF THE INVENTION

Electrical transmission cables, such as coaxial cables used for video satellite or cable television transmission, typically use a connector for attaching the cable to an input or output terminal such as a television jack or wall outlet. Most cable connectors generally include a connector body that is fashioned to connect to one end of the cable typically by crimping or compressing the connector body about the cable, and will have a threaded nut or frictional attachment member at an opposite end for connection to the terminal. In the past, problems have existed in the use of such conventional cable connectors. For example, it is often difficult to achieve a sufficiently tight and even crimping of the connector body about the cable in order to attach and seal the connector body fully about the cable. The crimped connection must be sufficient to lock the connector to the cable and provide a stable mechanical connection between the cable and the terminal, as well as prevent water or other materials from leaking through the crimped portion of the connector body.

Recently developed connectors have been designed with sealing rings, etc., to provide a more consistent seal between the connector body and the cable jacket. However, such newer types of connectors often require special tools for use and can be difficult and expensive to manufacture.

Accordingly, it can be seen that a need exists for an improved end connector for transmission cables that address the foregoing and other related and unrelated problems in the art.

SUMMARY OF INVENTION

Briefly described, the present invention is directed to a connector for electrical transmission cables and other similar wiring materials. Specifically, the present invention relates to an improved end connector for a coaxial cable for electrically connecting the coaxial cable to a terminal.

In one aspect, the present invention relates to an end connector having a connector body and a hex head for connecting the cable to a terminal (such as an input or output terminal or jack for a video transmission system). The connector body includes an inner tube and an outer fitting tube that are fitted or matched together in a telescoped, overlapping, or press-fit manner so as to engage the hex head; which is held in an axial locking engagement therewith, but generally is still permitted to spin freely with respect to the connector body. The end connector further includes a compression ring, a clamp sleeve, and a cylindrical connector end block. After a coaxial cable is inserted into the present invention, a crimping tool crimps the connector body, causing the clamp sleeve to be inverted as the cable jacket passes over a barb or tip head portion of the inner tube to engage and hold the coaxial cable within the connector body to prevent the cable from being pulled out from the connector body and to form a seal against moisture and debris passing into the connector.

Alternatively, in another aspect, the present invention is directed to an end connector that has a hex head for connecting to a terminal, an inner tube and a connector body, a clamp sleeve, and an end tube with end blocks. The inner tube and connector body generally are matched or fitted together to engage and hold the hex head axially to the connector body while still allowing the hex head to spin or rotate freely. After a coaxial cable is inserted into the open end of the connector body with its jacket passing over and being engaged by the barb of the inner tube, a crimping tool moves the connector body axially against the clamp sleeve to cause the clamp sleeve to invert and seal about the portion of the cable jacket engaged on the barb or tip head to hold and prevent the cable from being pulled out of the connector body and to form a water and moisture seal within the connector.

In still a further embodiment of the connector, the connector includes a connector body or outer fitting sleeve defining a generally C-shaped recess or channel terminating at a front end or ledge so as to define a slot along the outer wall of the connector body. An inner post or sleeve extends through the connector body and defines a passage in which a center conductor of the coaxial cable is received. A hex nut typically is rotatably mounted between the second, distal ends of the connector body and inner sleeve for connecting the cable to a terminal. A shell is received over and is axially movable along the outer wall of the connector body. The shell includes a first open end and a distal or second end spaced therefrom, and defines a central passage or opening through which the cable initially is received into the connector.

A shoulder portion is formed at an intermediate point along an inner wall of the shell so as to define a slotted recess between the shoulder portion of the outer shell and the front end or ledge portion of the connector body. A stepped edge further is formed adjacent the shoulder portion and defines a surface that is adapted to engage the outer jacket of the cable. A soft, pliable gasket generally is received in the slotted recess, and is compressible axially as the sleeve is moved along the connector body. As the gasket is compressed, it forms a seat against which a portion of the cable jacket bears as it bulges outwardly as the cable jacket is pressed axially against the end of the shoulder or front end of the C-shaped recess of the connector body by the forward sliding movement of the stepped edge of the outer sleeve along the connector body.

Other advantages and uses for the present invention will be more clearly understood by reference to the following description and drawings.

DETAILED DESCRIPTION OF THE INVENTION

Figure 1:
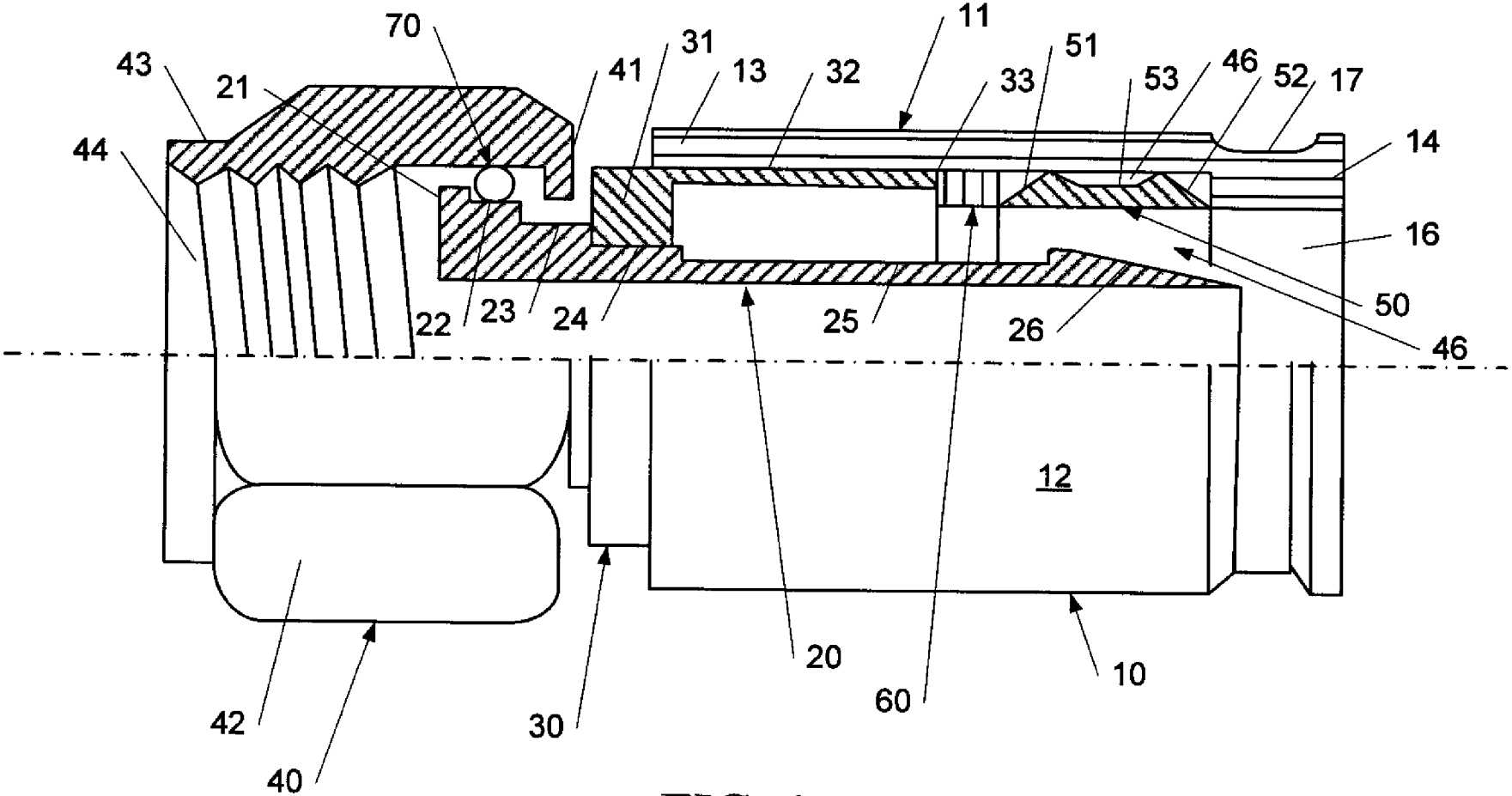
FIG. 1 is a partial sectional view of one example embodiment of an end connector according to the present invention.
Figure 2:
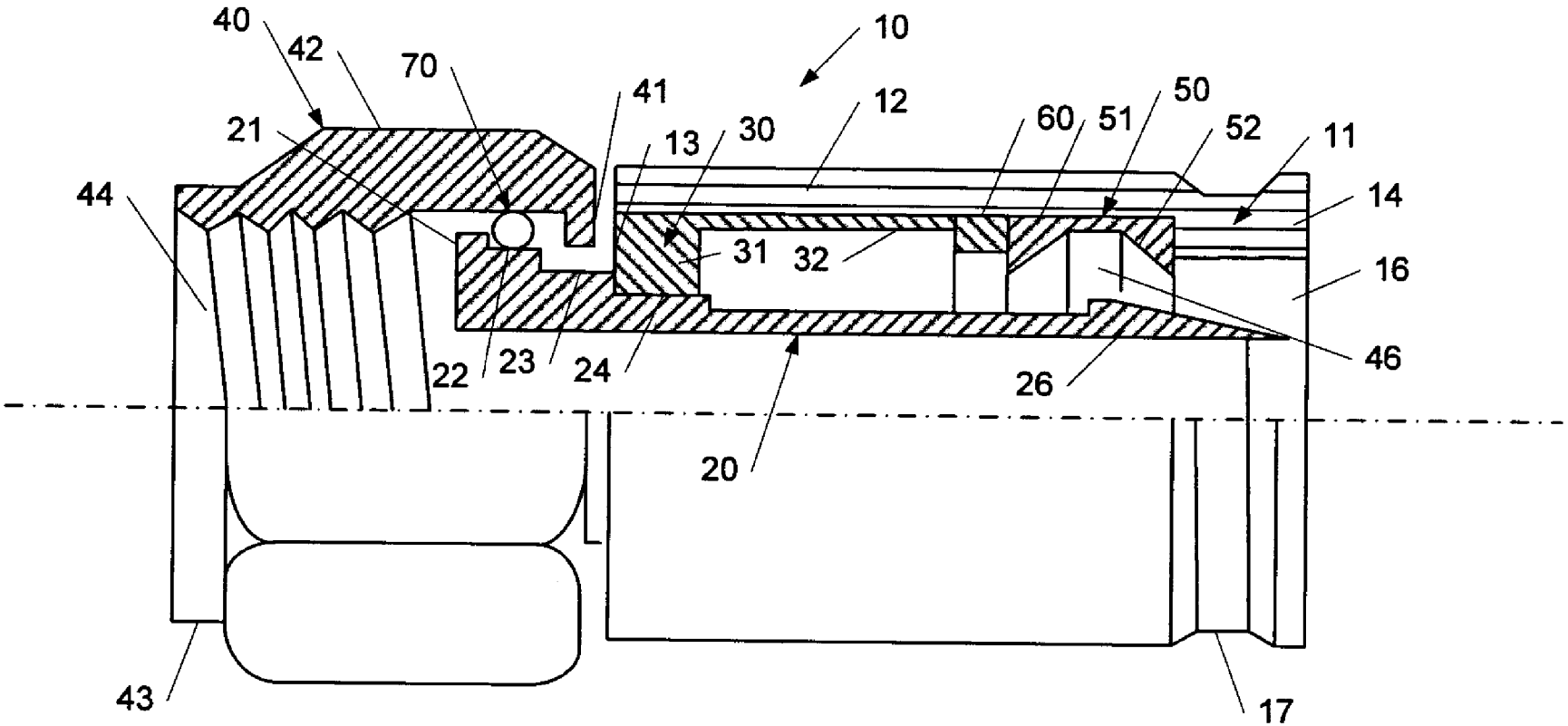
FIG. 2 is a partial section view of the end connector shown in FIG. 1 illustrating the end connector crimped without a coaxial cable.
Figure 3:
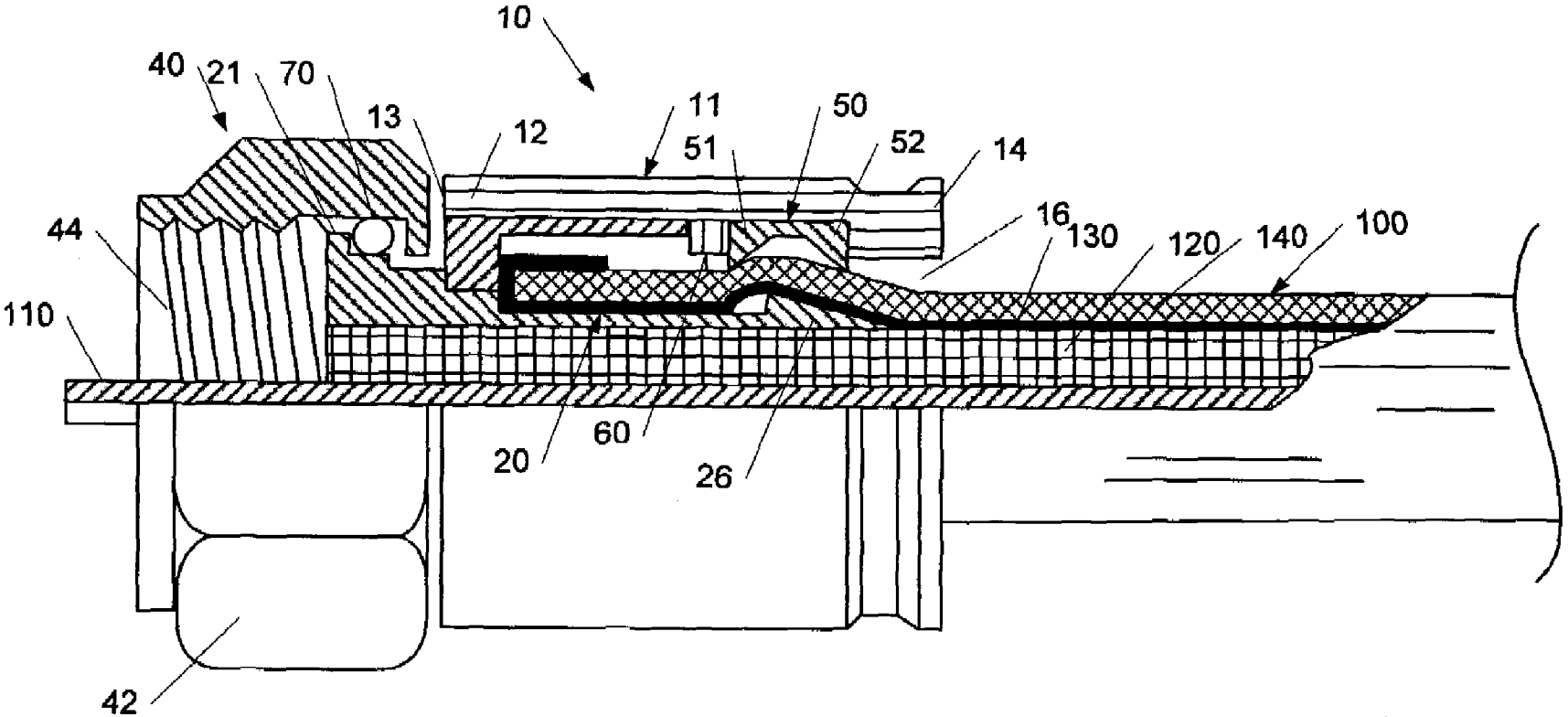
FIG. 3 is a partial section view of the end connector show in FIGS. 1 and 2 illustrating the end connector crimped to an end of a coaxial cable.

FIGS. 1, 2, and 3 illustrate one example embodiment of an end connector 10 according to the principles of the present invention, with the connector being shown in a pre-installed form and in an engaged form, after crimping both with and without a coaxial cable. The end connector 10 typically is comprised of a connector body 11, an inner tube 20, an outer fitting tube 30, a hex head 40, a clamp sleeve 50, a compression ring 60, and a sealing member such as an O-ring 70.

As shown in FIG. 1, the connector body 11 generally includes a substantially cylindrical tube or sleeve 12 defining an internal passage for receipt of an end of the cable therein and including a first open end 13, an end block 14 defining a second open, inlet end 16, having a groove 17 formed thereabout. The inner tube 20 is extended through the body 11 and engages the hex head 40 of the connector as shown in FIGS. 1-3. The inner tube 20 includes a clamp end 21 at a first end adjacent the hex head 40; a first shoulder 22, a second shoulder 23, and a third shoulder 24; a sleeve 25; and a barb or tip head 26 at its opposite end, adjacent the inlet end 16 of the connector body 11. The outer fitting tube 30 of the connector is received within the connector body, in an alignment surrounding the inner tube and projecting outwardly from the connector body between the first end 13 of the connector body and the hex head 40. The outer fitting tube further includes a fitting shoulder 31 that engages the second and third shoulders 23 and 24 of the innertube 20, and a sleeve 32 extending rearwardly from shoulder 31 to a distal end 33.

As shown in FIG. 1, the hex head 40 is rotatably mounted to the connector body 11, positioned at the outlet end thereof for connection of the end connector to a terminal or input/output jack. The hex head generally comprises a hex-nut type fastener and includes a clamp ring 41, a head shaped body 42 and a fitting neck 43, with screw threads 44 extending through the body 42 for threadably engaging a terminal or input/output jack to connect the cable thereto.

As further illustrated in FIG. 1, the clamp sleeve 50 is positioned within a cavity or space 46 defined between the distal end 33 of the outer fitting tube 30 and the end block 14 of the sleeve 12. The clamp sleeve 50 has a first clamp head 51, a second clamp head 52, and a sleeve body 53. Compression ring 60 generally is mounted adjacent the first clamp head 51, so as to provide a bearing surface against which the clamp sleeve 50 is compressed, and can have an inner diameter approximately equal or less than the inner diameter of clamp sleeve 50.

Additionally, the O-ring 70 is positioned between the body of the hex head and the first shoulder portion 22 of the inner tube 20 to provide a water/moisture seal between the hex head and inner tube. The inner tube shoulder 24 also can be tightly fitted against the outer tube fitting shoulder 31, as shown in FIG. 1, such that both the inner tube head 21 and the outer tube shoulder 31 can create a blockage or stop on both sides of the hex head clamp ring 41 and the o-ring 70. The hex head clamp ring 41 thus generally is prevented from axially disengaging from the connector body, while being loosely fitted to the inner second shoulder 23 so that the hex head 40 can be turned freely with respect to the connector body 11.

It is typical that the inner tube 20 and the outer fitting tube 30 can be made from brass or other similar highly conductive material; while the end connector body 10 and the hex head 40 can be made from brass, aluminum, zinc or alloys thereof, or other similar high strength materials. The clamp sleeve 50 typically can be made from various flexible and/or deformable plastic materials, aluminum, or other similar resilient or flexible materials; while the O-ring 70 generally is made from rubber or plastic.

During the installation of the end connector 10 according to the present embodiment, a coaxial cable 100 (FIG. 3) generally is prepared in such fashion that the center conductor 110 of the cable is exposed, with the cable insulation 120, braid 130, and jacket 140 being stripped or otherwise removed therefrom. The center conductor typically is left with a hex head length longer than that of the hex head so as to extend substantially through, and possibly out of the outlet of the hex head as shown in FIG. 3. The coaxial cable insulation 120 further has a head and shoulder length that generally extends further through the connector body than the ends of the coaxial cable braid 130 and jacket 140 (See FIG. 3).

The prepared coaxial cable end is pushed into the open inlet end 16 (FIGS. 1 and 2) of the connector body 11 of the end connector 10 and the connector body 11 is crimped thereabout. FIG. 3 shows a view of the after-crimped end connector with the coaxial cable 100 attached thereto. As a result of crimping, as indicated in FIG. 2, the outer fitting tube 30 generally is pushed longitudinally into the connector body 10 so that the end edge of he cable insulation is tightly fitted against both the outer fitting tube shoulder 31, extending inner tube 20, and the sleeve 32 of the connector body 11.

During such movement, the clamp sleeve 50 is also engaged and pushed inwardly against the compression ring 60 by the end block 14. As a result, the clamp sleeve 50 generally is forced to change shape, causing the first clamp head 51 portion to be raised radially outwardly toward and along the contacting surface of the compression ring 60, while at the same time the second clamp head 52 portion is raised raidially outwardly toward and along the contacting surface of the end block 12, as indicated in FIG. 2.

Eventually, the clamp sleeve is substantially inverted, as shown in FIGS. 2 and 3, with one or both of the first clamp head portions 51/52 then becoming folded or projected about the cable jacket 140 (FIG. 3) and braid 130 on both sides of the tip head or barb 26 on which the cable jacket 140 is engaged to help secure/clamp the cable and reinforce the mechanical strength of the connection. The clamp sleeve 50 further can be notched or weakened adjacent the clamp head portions to facilitate the inversion or reversal of the clamp sleeve during crimping. After the crimping process, the clamp sleeve 50 is thus formed with a substantially reversed "U" shape and is tightly clamped about the portion of the cable jacket 140 and braid 130 engaged and projecting over the tip head. This clamping engagement can help prevent the coaxial cable 100 being pulled out from the end connector and helps form a seal against outside water/moisture and debris. The O-ring 70 also helps to prevent water/moisture and debris passing into the connector from the front or hex head end of the connector.

Figure 4:
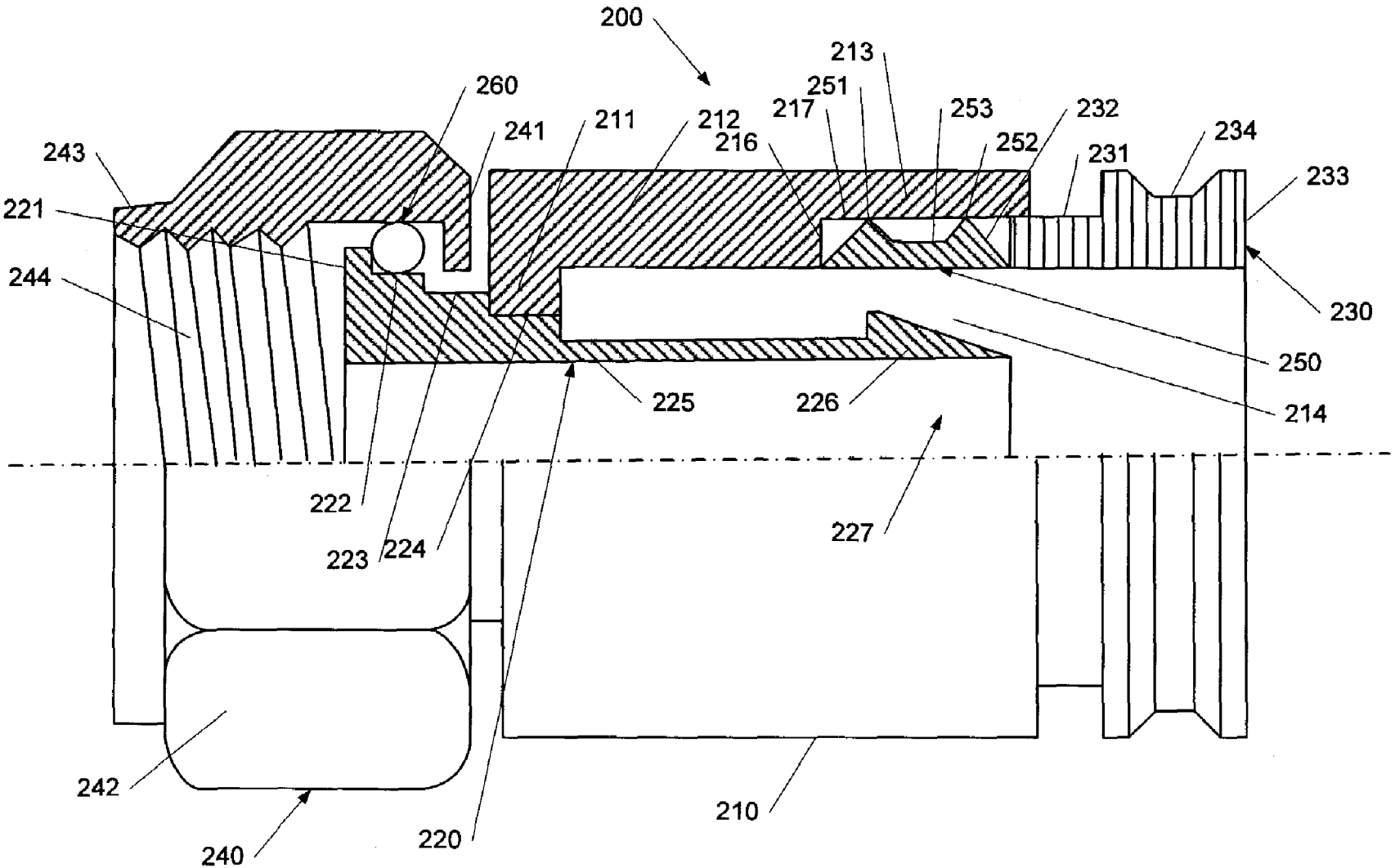
FIG. 4 is a partial sectional view of another embodiment of the end connector according to the present invention.
Figure 5:
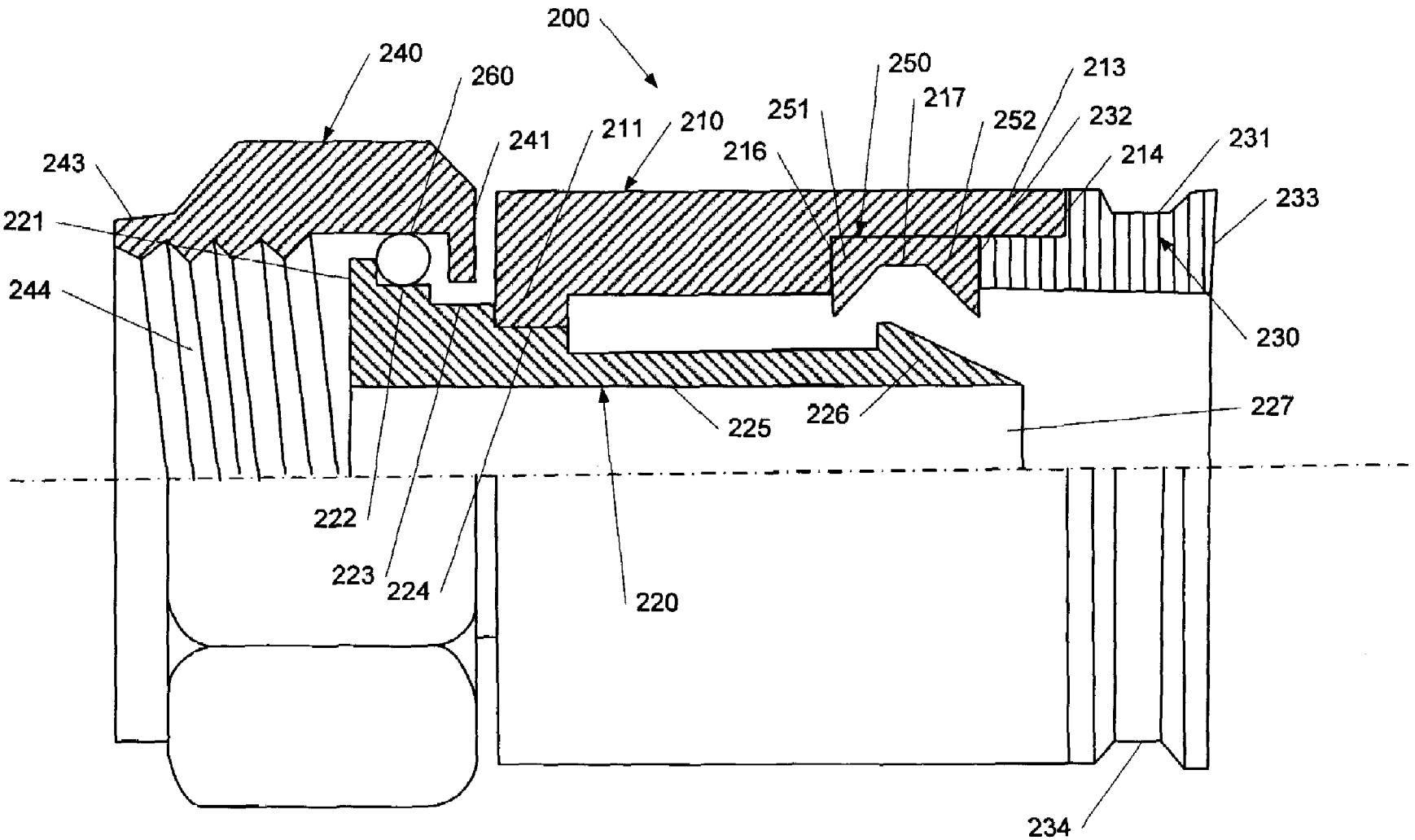
FIG. 5 is a partial section view of the end connector shown in FIG. 4 illustrating the end connector crimped without a coaxial cable.
Figure 6:
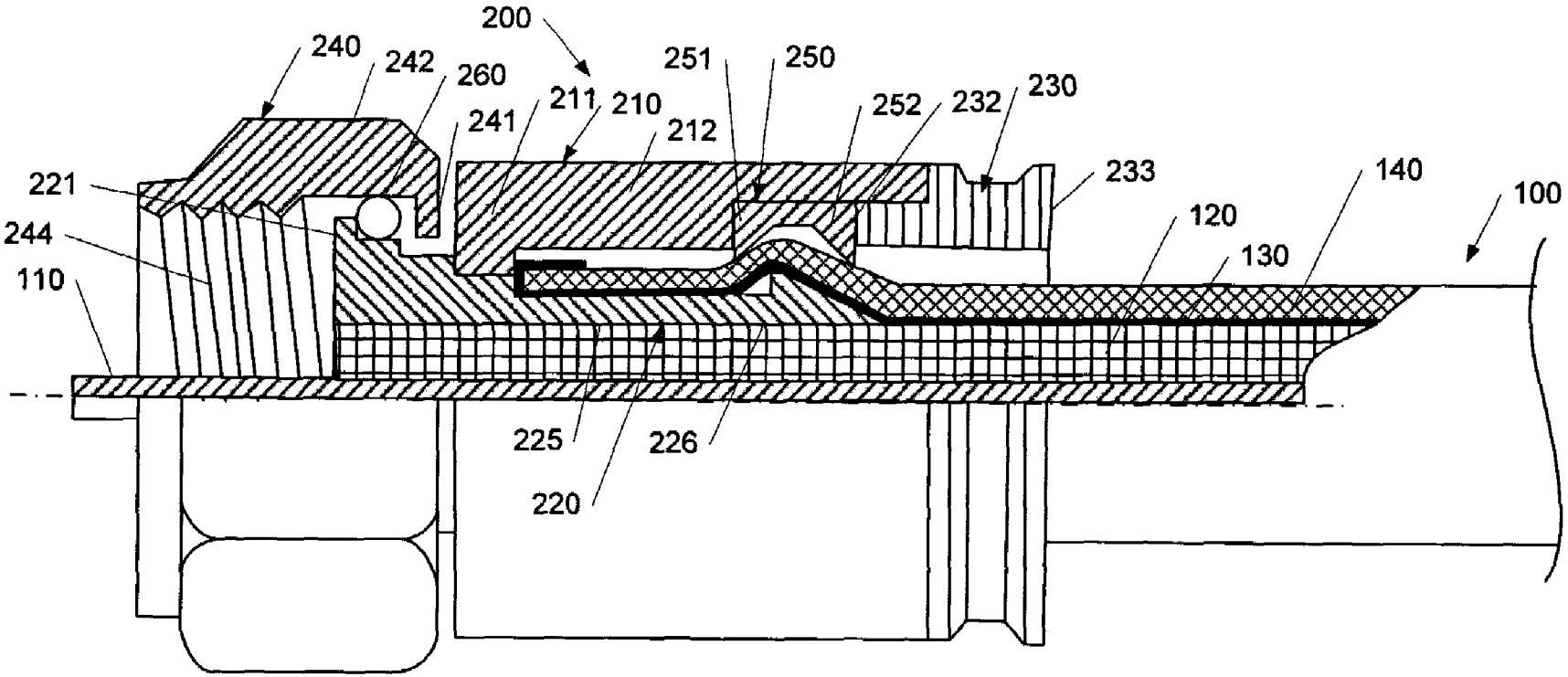
FIG. 6 is a partial section view of the end connector shown in FIGS. 4 and 5, illustrating the end connector crimped to an end of a coaxial cable.

FIGS. 4, 5, and 6 illustrate another example embodiment of the end connector 200 in a pre-installed form and its forms after crimping with and without a coaxial cable. In this embodiment, the end connector 200 generally is comprised of a connector body 210, an inner tube 220, an end tube 230, a hex head 240, a clamp sleeve 250, and a sealing ring such as an O-ring 260.

As shown in FIG. 4, the connector body 210 of this embodiment generally includes a fitting shoulder 211 defining a first end, a cylindrical sleeve or tube 212 defining an internal passage for the cable, an end sleeve portion 213 defining a second or open inlet end 214, and a shoulder or ledge portion 216 defining a recess 217 about the inlet end 214. The inner tube 220 extends through the sleeve 212 and has a clamp end 221 projecting through and past the fitting shoulder 211, a first shoulder 222, a second shoulder 223, a third shoulder 224, and a sleeve 225 having a tip head or barb 226 at its open end and defining a central passage 227. End tube 230 generally has a smaller diameter than the connector body 210 and projects outwardly from the end sleeve 213 of the body 212. The end tube 230 is moveable into the recess 217 of the connector body and defines an open inlet for insertion of the cable therein. The end tube 230 includes a tubular sleeve or body 231, a first end edge 232, a second end edge 233, and a groove 234.

Similar to the hex head 40 (FIG. 1) hex head 240 (FIG. 4) is a hex nut type fastener and includes a clamp ring 241, a hex shaped body 242, and a fitting neck 243, with screw threads 244 extending through the body 242 for the attachment of the connector to a terminal. As shown in FIG. 4, second and third inner tube shoulders 223 and 224 are fitted against and engaged by the body shoulder 211. Both the inner tube head 221 and the body shoulder 211 thus can create a blockage or stop on both sides of the hex head clamp ring 241 and the O-ring 260, with the hex head clamp ring 241 being loosely fitted about the inner second shoulder 223 so that the hex head 240 can be turned freely.

As additionally shown in FIG. 4, the clamp sleeve 250 is positioned with the recess 217 between the end tube 230 and the shoulder 216 of the connector body, and includes a first clamp head 251, a second clamp head 252, and a sleeve body 253. O-ring 260 generally can be positioned between the hex head body 242 and the first shoulder 222 of the inner tube 220, as indicated in FIG. 4, to provide a water/moisture seal adjacent the hex head end of the connector 200.

It is typical that the inner tube 220 and the end tube 230 can be made from brass or other similar highly conductive material, while the end connector body 210 and the hex head 240 can be made from brass, aluminum, zinc or alloys thereof, or other similar high strength materials; and with the clamp sleeve 250 generally being made from various flexible and/or deformable plastics, aluminum, or other similar resilient or flexible materials. The O-ring 260 generally is made from rubber or plastic.

During end connector installations, the coaxial cable 100 is prepared in substantially the same fashion as discussed above with respect to FIG. 3. After the prepared coaxial cable end has been pushed into the open inlet end of the end connector, as indicated in FIGS. 5 and 6, a crimp tool is used to press or crimp the end connector about the cable end. FIGS. 5 and 6 show the final view of an after-crimped end connector, both without (FIG. 5) and with (FIG. 6) a coaxial cable 100 therein. During crimping, the end tube 230 will be urged or pushed into the connector body 210, typically into a position tightly fitting against the connector body end sleeve 213. The clamp sleeve 250 also is engaged and pushed inwardly against shoulder 216 by the movement of the end tube 230. As a result, as shown in FIGS. 5 and 6, the clamp sleeve 250 is forced to change shape, with the first clamp head portion 251 being urged or raised radially outwardly toward and along the contacting surface of the compression ring 260, while at the same time the second clamp head portion 252 is urged or raised radially outwardly toward and along the contacting surface of the end tube 230.

Eventually, the clamp sleeve is substantially inverted, with the first and/or second clamp head portions 251/252 then becoming enveloped or folded about the portions of the cable jacket 140 (FIG. 6) and braid 130 that are engaged by the tip head or barb to help secure/clamp the cable and reinforce the mechanical strength of the connection. The clamp sleeve 250 further can be notched or weakened adjacent the claim head portions to facilitate the inversion or reversal of the clamp sleeve during crimping. After the crimping process, the clamp sleeve 250 is thus formed with a substantially reversed "U" shape and generally is tightly clamped about the cable jacket 140 and braid 130 over the tip head. This clamping engagement can help prevent the coaxial cable 100 being pulled out from the end connector and can help form a seal against the passage of water/moisture and debris therein.

Figure 7:
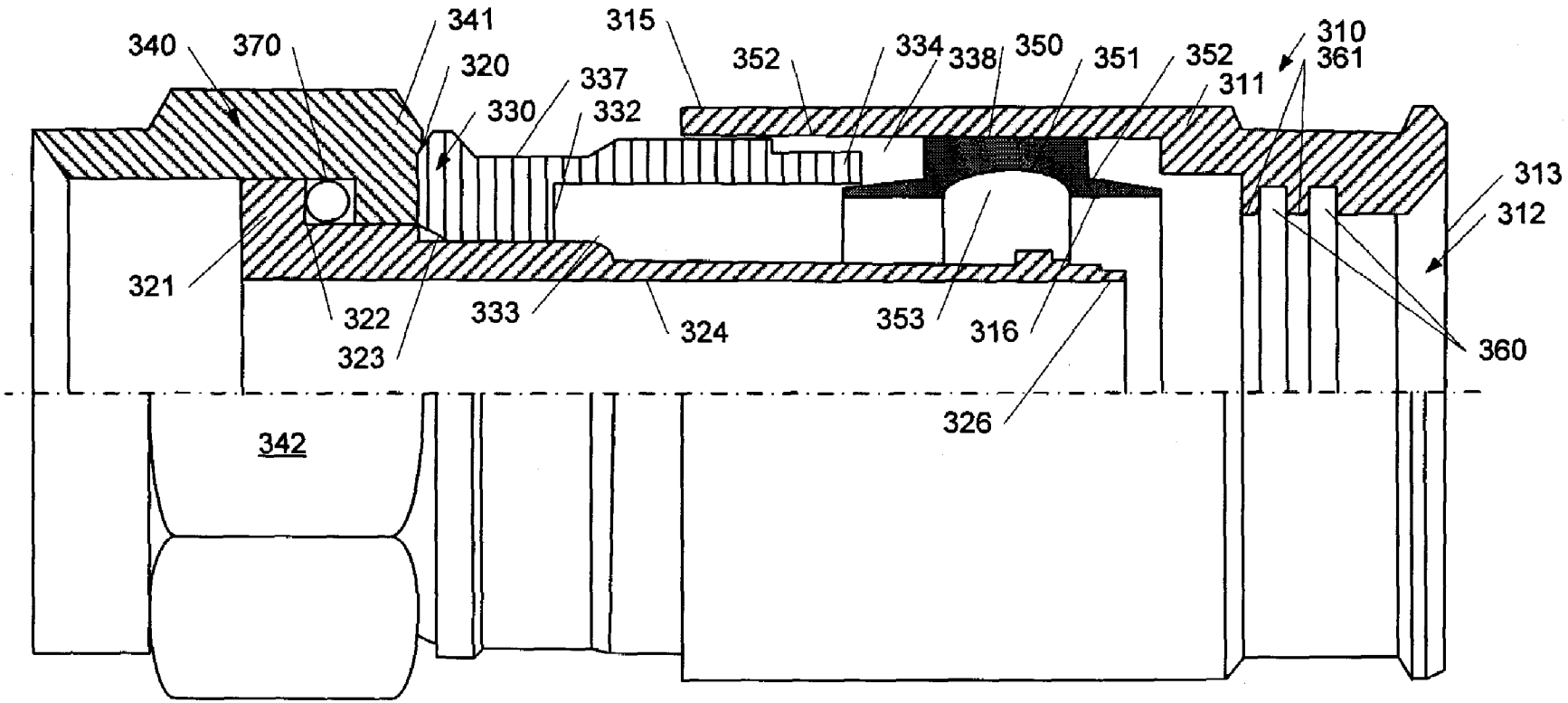
FIG. 7 is a partial sectional view of yet another embodiment of the end connector according to the present invention.
Figure 8:
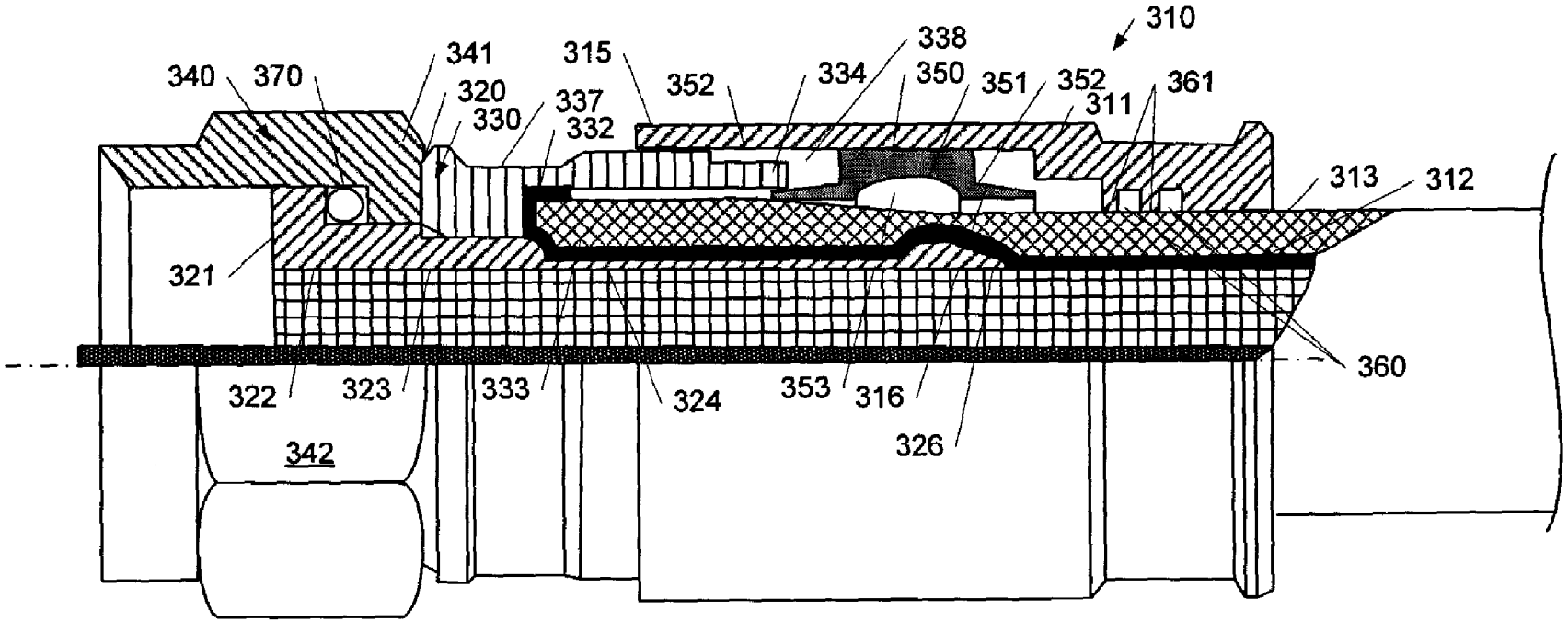
FIG. 8 is a partial sectional view of the end connector of FIG. 7 with the cable inserted therein prior to crimping.
Figure 9:
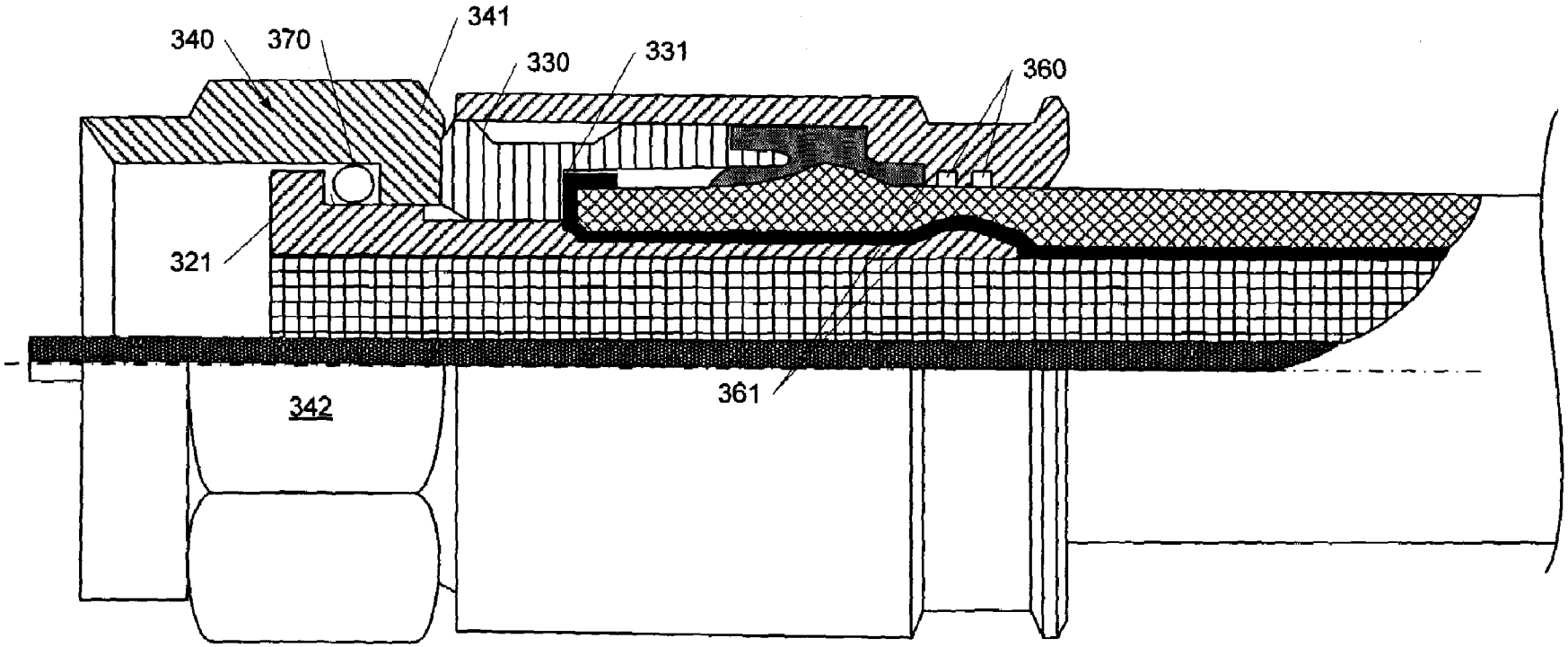
FIG. 9 is a partial sectional view of the end connector of FIGS. 7 and 8, illustrating the end connector being crimped to the coaxial cable.

As shown in FIGS. 7-9, in still another embodiment of the present invention, the connector 310 can include a cylindrical shell 311 defining an internal passage 312 for receipt of a cable 100 (FIGS. 8-9) therein, the shell 311 including a first, open inlet end 313 having a stepped edge 314 formed inwardly of the open inlet end 313 of the shell 311, a second end 315, and a shoulder portion 316. An inner tube 320 is extended through the passage 312 between a hex head nut 340, positioned at the opposite end of the connector, and an intermediate point along the passage. The inner tube 320 includes a first or proximal end 321, positioned adjacent the hex head nut, a first shoulder 322, a second shoulder 323, and a sleeve portion 324, terminating at a tapered, open, second or distal end 326. A connector body or outer fitting sleeve 330 surrounds the inner tube and projects rearwardly from a first end 331 adjacent the hex head 340 and forms a shoulder 332, defining a short, substantially C-shaped open ended recess or channel 333 that terminates at a front end or ledge 334 formed at a second end thereof. The first end 331 of the connector body 330 includes a sloped surface or bump 336 that helps to block moisture and debris from entering adjacent the hex head 340, with a groove or recess 337 additionally formed in the connector body adjacent the bump 336 to help reduce compression forces acting thereon during crimping. As shown in FIG. 7, the ledge 334 generally can be of a reduced profile so as to define a slot or groove 338 about the front or second end of the connector body or outer fitting sleeve.

The hex head 340 includes a clamp ring 341, a hex shaped body 342, and a fitting neck 343, with screw threads for attachment to a cable outlet. An O-ring 370 (FIGS. 7-9) further generally is engaged between the clamp ring 341 of the hex head 340 and proximal end 321 of the inner tube for sealing the hex head end of the connector. The proximal end 321 of the inner tube and the shoulder of the connector body 331 thus create a stop on both sides of the hex head clamp ring 341 and the O-ring 370. The hex head clamp ring 341 further generally is loosely fitted about the inner tube shoulder 320 so that the hex head 340 can be turned freely with respect to the rest of the connector.

As indicated in FIGS. 7 and 8, a soft, pliable gasket 350 will be positioned inside the internal passage 312 of the cylindrical outer shell 311. The gasket 350 generally can be formed from a compressible material such as a plastic, nylon, foams or other similar materials and can have a substantially cylindrical configuration with an outwardly projecting center portion 351 and flat substantially axially extending side portions 352 defining a concave recess 353. During crimping of the connector 310 to the cable, the inner tube and outer fitting tube portions of the connector are urged rearwardly against the cable in the direction of arrow 355, as indicated in FIG. 9, while the outer shell 311 is urged axially in the direction of arrow 355'. As it is moved forwardly, the stepped edge 314 of the shell urges the cable jacket toward and against the end of the recess 332 defined by the connector body. The movement of the shell 311 also tends to push the gasket 350 axially and along the slot or groove 338 formed about the front end or ledge 334 of the connector body 330, while the opposite side of the gasket is pressed forwardly by the shoulder portion 316 of the cylindrical outer shell 311.

As further indicated in FIG. 9, the cable jacket is urged axially by the inward movement of both the outer shell 311 and inner tube portion 320, causing it to bulge outwardly as it is pressed against the shoulder portion 381 of the end of the outer fitting tube, while the gasket 350 will deform and move into the slot or groove 338 between the ledge 334 of the connector body and the cylindrical outer shell 311, narrowing the recess 353 of the gasket 350. As a result, a receiving area or seat 357 is formed by the gasket into which a portion of the outer jacket of the cable projects as the outer jacket is caused to buckle outwardly as it is squeezed axially in the direction of arrows 355 and 355' by the sliding movement of the outer shell 311 and inner post/connector body 320/330.

Accordingly, during installation of the connector 310 on a coaxial cable 100, as indicated in FIGS. 8 and 9, the outer shell 311 will be slid or urged axially forwardly in the direction of arrow 355', sliding along the connector body or outer fitting sleeve 330 toward the hex nut 340, while the inner tube 320 and connector body are moved axially toward the cable. As the outer shell 311 and inner tube/connector body 320/330 are squeezed together, the outer jacket 140 of the cable is urged against the shoulder 331 at the end of the recess 333 formed in the outer fitting sleeve or connector body 330. At the same time, the gasket 350 is compressed axially against the shoulder of the outer fitting tube.

In addition, as further indicated in FIG. 9, the stepped edge 314 of the outer sleeve 311 tends to bite into and bear against the jacket to urge the jacket axially along the connector and can additionally help hold the jacket, and thus the cable, within the connector. The outer jacket of the cable thus is caused to buckle outwardly against the pliable gasket, which is being squeezed axially so that the buckled portion of the outer jacket presses and seats tightly against the gasket, while the gasket 350 seals around the buckled portion of the cable jacket to help attach the connector to the cable and resist removal of the cable out of the connector by hand. Still further, as shown in FIG. 7, spaced grooves 360 can be formed in the outer shell 311 adjacent the inlet end 313 thereof. The grooves define edges or teeth 361 that tend to engage the jacket of the cable during crimping. As a result, the grooves/teeth 360/361 enhance the pulling force exerted by the connector on the cable during crimping to help securely lock the connector to the cable and to help provide a substantially water-resistant seal about the jacket of the cable adjacent the rear end of the connector.

It will be further understood by those skilled in the art that while the present invention has been described above with reference to preferred embodiments, numerous variations, modifications, and additions can be made thereto, including combining the various disclosed embodiments in whole or in part, without departing from the spirit and scope of the present invention as set forth in the following claims.

What is claimed is:

1. A connector for connecting a cable to a terminal, comprising:
   - A connector body defining a passage through which an end of the cable is received;
   - a hex head fastener rotatably connected to the connector body; and
   - a clamp sleeve having first and second clamp head portions with a sleeve body therebetween, the clamp sleeve being formed from a flexible material so as to become substantially inverted upon application of a clamping force thereto; and
   - an inner tube over which a jacket portion of the cable is received and an outer fitting tube having a first end forming a shoulder and a second end spaced from a block end of the connector body, adapted to engage and urge the clamp sleeve along the inner tube, causing the clamp sleeve to invert and engage a jacket portion of the cable to hold the end of the cable within the connector body, upon axial movement of the connector body during crimping about the cable.

2. The connector of claim 1 and further comprising a compression ring mounted adjacent the second end of the outer fitting tube.

3. A connector for connecting a cable to a terminal, comprising:
   - A connector body defining a passage through which an end of the cable is received;
   - a hex head fastener rotatably connected to the connector body; and
   - a clamp sleeve having first and second clamp head portions with a sleeve body therebetween, the clamp sleeve being formed from a flexible material so as to become substantially inverted so as to engage and hold the end of the cable within the connector body upon application of a clamping force thereto; and
   - an inner tube having a first end received within the hex head fastener and a second end formed with a barb for engaging a jacket portion of the cable.

4. The connector of claim 3 and wherein the connector body comprises a sleeve having a block end adapted to engage and urge the clamp sleeve forwardly so as to comprise the clamp sleeve to invert and engage a jacket portion of the cable upon axial movement of the connector body during crimping about the cable.

5. The connector of claim 3 and further comprising a compression ring positioned along the connector body adjacent the clamp sleeve and against which the clamp sleeve is compressed.

6. The connector of claim 3 and wherein the clamp sleeve comprises a flexible gasket having spaced clamp head portions defining a recessed area therebetween.

* * * * *